US005499735A

United States Patent [19]

Chen

[11] Patent Number: 5,499,735

[45] Date of Patent: Mar. 19, 1996

[54] CLOSURE ASSEMBLY FOR VACUUM SEALED CONTAINERS

[76] Inventor: Cin-Chen Chen, No. 35, Lane 108, Chien Pin 8 Street, Tainan, Taiwan

[21] Appl. No.: 359,750

[22] Filed: Dec. 20, 1994

[51] Int. Cl.[6] ..... B65D 51/16

[52] U.S. Cl. ..... 220/231; 215/312; 220/212; 220/227; 251/339; 251/342; 251/900

[58] Field of Search ..... 220/212, 227, 220/231, 367; 215/312; 137/901; 251/339, 342, 900

[56] References Cited

U.S. PATENT DOCUMENTS

| | | | |
|---|---|---|---|
| 1,606,519 | 11/1926 | Exten | 220/212 |
| 4,016,999 | 4/1977 | Denzer | 220/231 |
| 4,142,645 | 6/1979 | Walton | 215/312 X |
| 4,428,478 | 1/1984 | Hoffman | 220/231 X |
| 5,288,053 | 2/1994 | Young | 251/339 X |
| 5,347,918 | 9/1994 | Chen | 220/231 |
| 5,405,038 | 4/1995 | Chuang | 220/231 |

FOREIGN PATENT DOCUMENTS

| | | |
|---|---|---|
| 524551 | 4/1993 | European Pat. Off. . |
| 428066 | 4/1926 | Germany . |

*Primary Examiner*—Allan N. Shoap
*Assistant Examiner*—Robin A. Hylton
*Attorney, Agent, or Firm*—Morton J. Rosenberg; David I. Klein

[57] ABSTRACT

An air valve apparatus for vacuum sealed containers comprises a cover having a groove at center portion and an aperture at center portion concentrically with respect to the groove. The aperture has projecting a pair of circular walls both from the upper side to receive an air releasing device and from the lower side to receive an anti-dust cover thereon, respectively. The air releasing device has a hollow body and includes a pressing knob at top portion, an integral pin extending downwardly in a distance near a ball which is seating on top of an O-ring which is fitted on top of the aperture to form a hermits seal between the vacuum sealed container and the outside. By pressing the knob downward, the pin will urge the ball to one side that allows air to flow into the container and releases the vacuum status.

2 Claims, 3 Drawing Sheets

CLOSURE ASSEMBLY FOR VACUUM SEALED CONTAINERS

FIELD OF THE INVENTION

This invention relates to a closure assembly employing an air valve apparatus. More specifically, it relates to a closure assembly for a vacuum sealed container having means for actually allowing air into a vacuum sealed one of such containers.

BACKGROUND OF THE INVENTION

It has been very popular to store items such as food items in a vacuum sealed container in order to maintain their freshness, as well as to protect them from moisture in the environment. A problem is presented in such storage of items in vacuum sealed containers, however, when it becomes necessary to remove the items from the container. A vacuum sealed container cannot be opened unless air is first allowed into that container. Unfortunately, prior art closure assemblies for vacuum sealed containers lack a suitable means for conveniently allowing air into the container to unseal the same.

SUMMARY OF THE INVENTION

It is the primary objective of the present invention to provide a closure assembly for a vacuum sealed container having an air valve apparatus which facilitates the pumping of air from and allowing air into a vacuum sealed container.

It is another objective of the present invention to provide a closure assembly for a vacuum sealed container having an air valve apparatus which is simple in structure and is easy to operate.

It is a further objective of the present invention to provide a closure assembly for a vacuum sealed container having an air valve apparatus which may be inexpensively manufactured.

The closure assembly for vacuum sealed containers of the present invention accomplishes these and other objectives and thereby overcomes the shortcomings in the prior art by providing an air passage actuation member, a substantially spherical air block member, an annular seal member, and a dust cover member coupled to an appropriately contoured cover member. Manual actuation of the air passage actuation member allows passage of air into the vacuum sealed container sealed by the closure assembly to release the vacuum seal.

DETAILED DESCRIPTION OF THE PREFERRED EMBODIMENT

Figure 1:
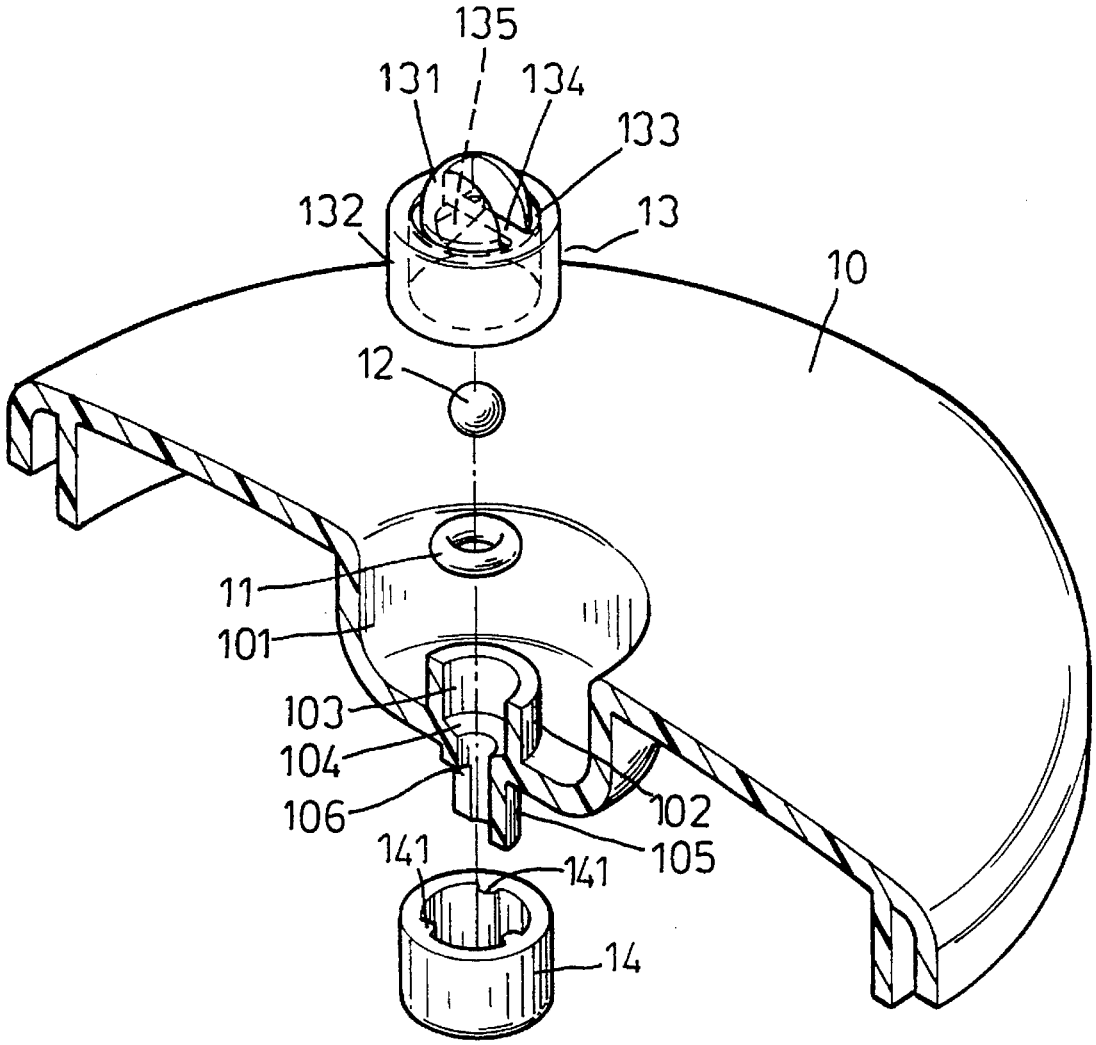
FIG. 1 is an exploded perspective view, partially cutaway, of the preferred embodiment of the present invention.
Figure 2:
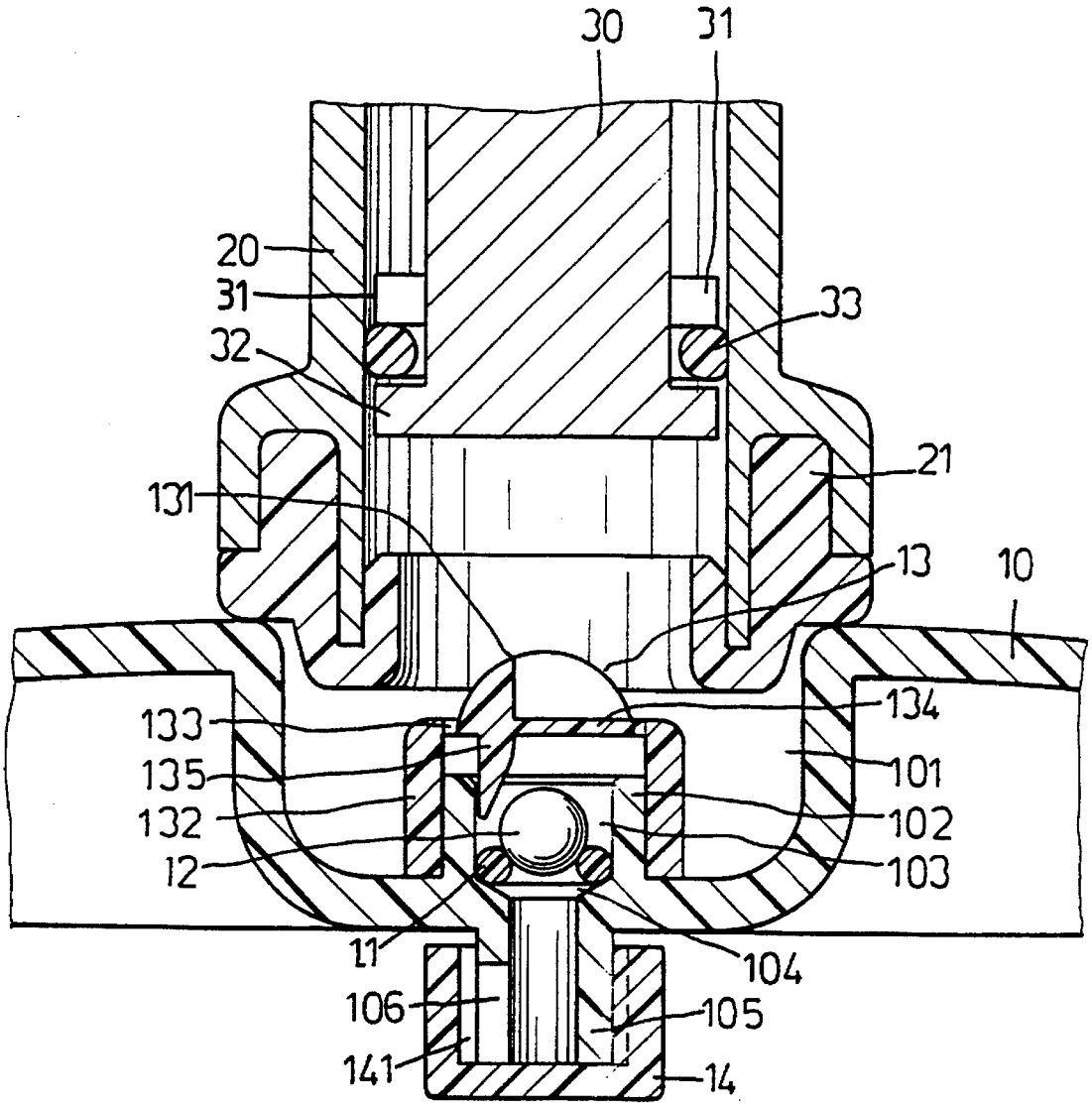
FIG. 2 is a cross-sectional view of the preferred embodiment of the present invention having an air pump coupled thereto; and, FIG. 3 is a cross-sectional view of the preferred embodiment of the present invention being actuated for passage of air therethrough.
Figure 3:
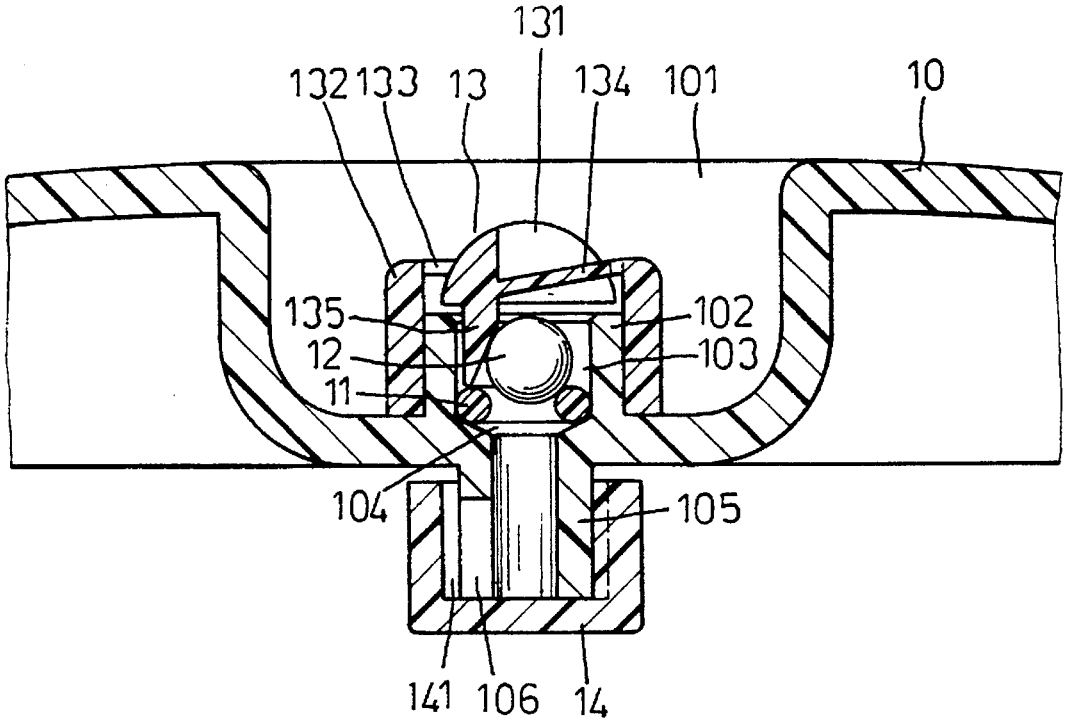

Referring now to FIGS. 1–3, there is shown the preferred embodiment of the subject closure assembly for a vacuum sealed container. It should be noted that the Figures and the descriptions contained in the following paragraphs are presented for the purpose of illustrating the preferred embodiment and not for the purpose of limiting in any way the inventive concept illustrated therein.

There is shown in FIG. 1 a cover member 10 having a recessed central portion 101 and a through opening 103 formed therein to receive an air releasing device 13 and a dust cover member 14. The cover member 10 has a generally circular shape so as to engage the opening of a vacuum sealed container. Formed on the respective sides of the recessed central portion 101 is an upwardly-projecting upper wall projection 102 and a downwardly-projecting lower wall projection 105. A circular inclined surface 104 is formed within the inner bottom periphery of the upper wall projection 102 to yield a countersunk through opening 103, so adapted to receive annular air seal member, or an O-ring, 11 composed of an elastomeric material. A substantially spherical air block member, or ball, 12 is disposed on the O-ring 11. Formed in the lower wall projection 105 are a plurality of longitudinal air passage slots 106.

The cross-section of air releasing device 13 is, generally, an inverted U-shape. It is thus adapted to matingly couple with the upper wall projection 102. Device 13 includes an air passage actuation member, or knob, 131 integrally connected to a circular wall portion 132 by a rib 134. A gap 133 between the circular wall portion 132 and the knob 131 is maintained to allow room for manual actuation of knob 131, as well as to provide a means for air passage. The circular wall portion 132 has an inner diameter slightly greater than the outer diameter of the upper wall projection 102, such that the circular wall portion 132 can receive therein the upper wall projection 102.

A pin portion 135 is integrally formed onto the rib 134 extending downwardly therefrom. Normally, the free end of the pin portion 135 does not contact the ball 12. When knob 131 is manually actuated, a sufficient extent, however, the pin portion 135 is caused to be displaced downward to make contact with the ball 12, urging it to be removed from its air-sealing engagement with the O-ring 11. Air passage into the vacuum sealed container is thus allowed.

The cross-section of dust cover member 14 is U-shaped. Dust cover member 14 has an inner diameter slightly greater than the outer diameter of the lower wall projection 105. Dust cover member 14 has formed thereon ribs 141 extending inward which correspond both in number and shape to the air passage slots 106 of the lower wall projection 105 so as to enable the mated coupling of dust cover member 14 with the lower wall projection 105.

To operate the closure assembly of the present invention, the air releasing device 13 is mated to the upper wall projection 102, and the dust cover member 14 is mated to the lower wall projection 105, as shown in FIG. 2. Once the closure assembly is assembled and placed on a vacuum sealed container, an air pump 20 is fitted within the recessed central portion 101 of the cover member 10 and air is drawn from the vacuum sealed container. The air pump 20 has a hollow body having coupled thereto a telescoping rod 30 and a washer 21 at a bottom portion thereof. The rod 30 includes a groove around its bottom portion defined by upper and lower circular protrusions 31 and 32. The groove is adapted to receive an O-ring 33 therein.

The operation of air pump 20 is known in the prior art and does not constitute a part of the present invention. It is described only to illustrate a typical application of the present invention.

I claim:

1. A closure assembly for releasably sealing a vacuum sealed container comprising:

(a) a cover member for covering an opening of said vacuum sealed container, said cover member having a recessed central portion defined by opposed top and bottom surfaces, said central portion having formed therein a through opening extending in an axial direction, an upper wall projection projecting from said top surface, and a lower wall projection projecting from said bottom surface, the portion of said through opening adjacent said top surface being countersunk, said upper and lower wall projections each having opposed inner and outer wall surfaces, said inner wall surface of each said upper and lower wall projections substantially encircling said through opening about said axial direction, said lower wall projection having formed through said inner and outer wall surfaces thereof at least one air passage slot;

(b) an annular air seal member received on said countersunk portion of said through opening;

(c) an air block member having a substantially spherical contour, said air block member being displaceably received on said air seal member within said inner wall surface of said upper wall projection for blocking passage of air through said through opening;

(d) an air passage actuation member coupled to said upper wall projection, said air passage actuation member having means responsive to manual actuation thereof for contacting and reversibly displacing said air block member to enable said passage of air through said through opening; and, (e) a dust cover member coupled to said lower wall projection for impeding the passage of dust into said vacuum sealed container.

2. A closure assembly for releasably sealing a vacuum sealed container comprising:

(a) a cover member for covering an opening of said vacuum sealed container, said cover member having a recessed central portion defined by opposed top and bottom surfaces, said central portion having formed therein a through opening extending in an axial direction, an upper wall projection projecting from said top surface, and a lower wall projection projecting from said bottom surface, the portion of said through opening adjacent said top surface being substantially countersunk, said upper and lower wall projections each having opposed inner and outer wall surfaces, said inner wall surface of each said upper and lower wall projections substantially encircling said through through opening about said axial direction, said lower wall projection having formed through said inner and outer wall surfaces thereof at least one air passage slot;

(b) an annular air seal member received on said countersunk portion of said through opening;

(c) an air block member having a substantially spherical contour, said air block member being displaceably received on said air seal member within said inner wall surface of said upper wall projection for blocking passage of air through said through opening;

(d) an air passage actuation member coupled to said upper wall projection, said air passage actuation member having a cantilevered actuation knob and a pin section coupled thereto, said pin section being reversibly displaceable into engagement with said air block member for reversible displacement thereof responsive to manual actuation of said actuation knob, said reversible displacement of said air block member enabling said passage of air through said through opening;

(e) a dust cover member coupled to said lower wall projection for impeding the passage of dust into said vacuum seal container; and, (f) an air pump removably coupled to said cover member for removing therethrough air in said vacuum sealed container.

* * * * *